US009416638B2

(12) United States Patent
Zhou

(10) Patent No.: US 9,416,638 B2
(45) Date of Patent: Aug. 16, 2016

(54) MULTI-LATERAL WELL SYSTEM

(71) Applicant: Saudi Arabian Oil Company, Dhahran (SA)

(72) Inventor: Shaohua Zhou, Dhahran Hills (SA)

(73) Assignee: Saudi Arabian Oil Company, Dhahran (SA)

( * ) Notice: Subject to any disclaimer, the term of this patent is extended or adjusted under 35 U.S.C. 154(b) by 142 days.

(21) Appl. No.: 14/313,546

(22) Filed: Jun. 24, 2014

(65) Prior Publication Data

US 2015/0369022 A1 Dec. 24, 2015

(51) Int. Cl.

| | |
|---|---|
| ***E21B 43/12*** | (2006.01) |
| ***E21B 34/10*** | (2006.01) |
| ***E21B 44/00*** | (2006.01) |
| ***E21B 41/00*** | (2006.01) |
| ***E21B 7/06*** | (2006.01) |

(52) U.S. Cl.

CPC ..... *E21B 43/12* (2013.01); *E21B 7/061* (2013.01); *E21B 34/10* (2013.01); *E21B 41/0035* (2013.01); *E21B 44/005* (2013.01)

(58) Field of Classification Search

CPC ..... E21B 43/12; E21B 43/14; E21B 44/005; E21B 41/0035; E21B 7/061; E21B 34/10; E21B 34/08; E21B 34/14

See application file for complete search history.

(56) References Cited

U.S. PATENT DOCUMENTS 5,318,121 A 6/1994 Brockman et al.
5,533,573 A 7/1996 Jordan, Jr. et al.
5,697,445 A * 12/1997 Graham ..... E21B 7/061 166/117.6
5,954,134 A 9/1999 Longbottom
6,003,601 A 12/1999 Longbottom
6,053,254 A 4/2000 Gano
6,079,493 A 6/2000 Longbottom et al.
6,092,593 A 7/2000 Williamson et al.
6,125,937 A * 10/2000 Longbottom ..... E21B 23/002 166/117.5
6,209,636 B1 * 4/2001 Roberts ..... E21B 17/1092 166/117.6
6,263,968 B1 7/2001 Freeman et al.
6,561,277 B2 5/2003 Algeroy et al.

(Continued)

FOREIGN PATENT DOCUMENTS

GB 2317406 A 3/1998
WO 01/25587 A1 4/2001

OTHER PUBLICATIONS

PCT International Search Report and The Written Opinion of the International Searching Authority dated Nov. 10, 2015; International Application No. PCT/US2015/037293; International Filing Date: Jun. 24, 2015.

*Primary Examiner* — Shane Bomar

(74) *Attorney, Agent, or Firm* — Bracewell LLP; Constance Gall Rhebergen

(57) ABSTRACT

A production system for use in a wellbore having a main bore with an axis, a lower lateral bore, and an upper lateral bore, includes a hollow whipstock with a central bore. The hollow whipstock is secured to the main bore between the lower lateral bore and the upper lateral bore. A sleeve assembly has a moveable inner sleeve with an outer diameter smaller than an inner diameter of the central bore of the hollow whipstock, and a moveable outer sleeve with an outer diameter larger than the inner diameter of the central bore of the hollow whipstock. A flow control valve is located in the main bore above the upper lateral bore. The flow control valve has an inner tubing member in selective fluid communication with the lower lateral bore and an annular conduit in selective fluid communication with the upper lateral bore.

22 Claims, 7 Drawing Sheets

(56) References Cited

U.S. PATENT DOCUMENTS

| | | | | |
|---|---|---|---|---|
| 6,732,802 | B2 * | 5/2004 | Smith | E21B 33/14 166/285 |
| 7,337,846 | B2 | 3/2008 | Restarick et al. | |
| 8,220,547 | B2 | 7/2012 | Craig et al. | |
| 8,376,054 | B2 | 2/2013 | Lang et al. | |
| 2001/0035288 | A1 * | 11/2001 | Brockman | E21B 17/003 166/65.1 |
| 2003/0221843 | A1 * | 12/2003 | Fipke | E21B 43/26 166/381 |
| 2004/0055752 | A1 * | 3/2004 | Restarick | E21B 23/03 166/313 |
| 2005/0121190 | A1 | 6/2005 | Oberkircher et al. | |
| 2011/0011580 | A1 * | 1/2011 | Clark | E21B 33/124 166/244.1 |
| 2013/0020088 | A1 * | 1/2013 | Dyer | E21B 34/063 166/373 |
| 2013/0319693 | A1 | 12/2013 | Sponchia et al. | |

* cited by examiner

MULTI-LATERAL WELL SYSTEM

BACKGROUND OF THE INVENTION

1. Field of the Invention

The present invention relates to operations in a wellbore associated with the production of hydrocarbons. More specifically, the invention relates to systems for developing and producing dual-lateral wells.

2. Description of the Related Art

Often in the recovery of hydrocarbons from subterranean formations, wellbores are drilled with multiple highly deviated or horizontal portions that extend through separate hydrocarbon-bearing production zones. Each of the separate production zones can have distinct characteristics such as pressure, porosity and water content, which, in some instances, can contribute to undesirable production patterns. Many onshore and offshore fields with multiple reservoirs utilize high level technology advancement multi-lateral (TAML) systems to provide the ability to produce two separate reservoirs with different pressure regimes and separate lateral access. However such high level TAML systems are costly due to very expensive equipment, and the significant number of rig operating days required for their use. TAML systems also historically have an inherent risk of completion problems and failures.

As a separate matter, any workover involving entry into a branched lateral portion of a well in an open hole environment can be lengthy, costly, and introduce risk due to uncertainties in entering the branched lateral portion. Entering a particular lateral is often done by trial and error using a bent-sub as a guide and rotating an associated tool string in order to orient the guide. A measurement while drilling (MWD) device on a tool is sometimes used to help orient the guide, and a retrievable bridge plug or a drillable plug is sometimes installed in the motherbore in connection with these techniques to act as a temporary barrier. So if a lateral wellbore is tagged by any tool at the bottom of the string, the tool string can be pulled back up and reworked into the desired lateral wellbore. This is not always practical because typical completion equipment has a limited torque capability and often requires a ball operated pressure release device that precludes use of a MWD tool. Also, rotating completion equipment accidently across the window exit from, the motherbore can damage the equipment.

Another approach sometimes employed for entering a lateral bore involves running and setting a retrievable whipstock in the exact location and orientation of a previous whipstock location, so that the whipstock can easily guide any work string into the lateral wellbore. However, this approach is not often attempted because setting a whipstock at an exact location and orientation along an existing wellbore remains a challenge and retrieval of the whipstock may not be always assured.

SUMMARY OF THE INVENTION

The systems and methods of this disclosure provide a multi-lateral well design that can allow selective full access for production logging, reservoir stimulation, or water shut-off in multiple lateral wellbores to maximize production of each development, and can be used on developments with offshore platforms with limited slots and on onshore well sites. Embodiments of this disclosure allow for optimization of the field development potential. Production from two lateral wellbores can be commingled, or produced separately, without a complicated and expensive high level TAML system, substantially simplifying the construction of multi-lateral junctions while still providing for pressure isolation of the laterals.

Embodiments of this disclosure addresses rig operational risks such as being unable retrieve a whipstock, and failure to complete the multi-lateral well because of a complicated requirement of properly orienting a tool across the window exit/lateral conjunction, as well as risks associated with having limited the access to the lateral bores.

In an embodiment of this disclosure, a production system for use in a wellbore having a main bore with an axis, a lower lateral bore, and an upper lateral bore, includes a hollow whipstock with a central bore. The hollow whipstock is secured to the main bore between the lower lateral bore and the upper lateral bore. A sleeve assembly has a moveable inner sleeve with an outer diameter smaller than an inner diameter of the central bore of the hollow whipstock, and a moveable outer sleeve with an outer diameter larger than the inner diameter of the central bore of the hollow whipstock. A flow control valve is located in the main bore above the upper lateral bore. The flow control valve has an inner tubing member in selective fluid communication with the lower lateral bore and an annular conduit in selective fluid communication with the upper lateral bore.

In alternate embodiments, the sleeve assembly can have an upper end located in the main bore axially above the upper lateral bore. The inner sleeve can be sized to be selectively insertable into the central bore of the hollow whipstock. The outer sleeve can be sized to be selectively insertable into the upper lateral bore. The sleeve assembly can have an intermediate member that circumscribes a portion of the moveable inner sleeve and is circumscribed by a portion of the moveable outer sleeve. The intermediate member can be a tubular member that is statically secured within the main bore.

In other alternate embodiments, the flow control valve has a sliding sleeve system. The sliding sleeve system includes a sliding sleeve moveable between an open position where fluids from the annular conduit can flow into an exit port of the annular conduit, and a closed position where fluids from the annular conduit are prevented from flowing into the exit port. A biasing member urges the sliding sleeve towards an open position or a closed position. An opening pressure surface is acted on by main bore fluids. A closing pressure surface is acted on by inner tubing member fluids such that when forces on the closing pressure surface exceed forces on the opening pressure surface and overcome the biasing member, the sliding sleeve is moved towards a closed position.

In yet other alternate embodiments, the system has a production packer sealing the main bore axially above the sleeve assembly. The inner tubing member of the flow control valve has a tubing entry end in fluid communication with the sleeve assembly, and a tubing exit end in fluid communication with the main bore axially above the production packer. The annular conduit of the flow control valve has an annulus entry end in fluid communication with the main bore axially below the production packer, and an exit port in fluid communication with the tubing exit end.

In still other alternate embodiments, the flow control valve has a valve member located in the inner tubing member moveable between an open position where fluids can pass through the inner tubing member of the flow control valve, a closed position where fluids are prevented from passing through the inner tubing member of the flow control valve, and intermediate positions between the open position and the closed position. The flow control valve can have a choke member, the choke member being extendable across an annular exit port, varying a cross sectional area of the annular exit port.

In other alternate embodiments, an inner tubing member pressure gauge senses an inner tubing member fluid pressure, and pressure an annular conduit pressure gauge senses an annular conduit fluid pressure. A hydraulic control system is in communication with a valve member located in the inner tubing member and with a choke member located between a central flow path of the inner tubing member and the annular conduit.

In another embodiment of the current application, a production system for use in a wellbore having a main bore with au axis, a lower lateral bore, and an upper lateral bore includes a hollow whipstock with a central bore. The hollow whipstock is secured to the main bore between the lower lateral bore and the upper lateral bore. A sleeve assembly has a moveable inner sleeve with an outer diameter smaller than an inner diameter of the central bore of the hollow whipstock. A moveable outer sleeve has an outer diameter larger than the inner diameter of the central bore of the hollow whipstock. An intermediate member is located between the moveable inner sleeve and the moveable outer sleeve, the intermediate member being statically secured within the main bore. A flow control valve is located in the main bore above the upper lateral bore. The flow control valve has an inner body with a central flow path in fluid communication with the sleeve assembly, and an outer casing circumscribing a portion of the inner body and defining annular conduit between the inner body and the outer casing, the annular conduit being in fluid communication with the main bore.

In alternate embodiments, the flow control valve has a sliding sleeve system that includes a sliding sleeve moveable between an open position where fluids from the annular conduit can flow from the annular conduit into an exit port of the annular conduit, and a closed position where fluids from the annular conduit are prevented from flowing into the exit port. A biasing member urges the sliding sleeve towards the open position or a closed position. An opening pressure surface is acted on by main bore fluids and a closing pressure surface is acted on by central flow path fluids such that when forces on the closing pressure surface exceeds forces on the opening pressure surface and overcome the biasing member, the sliding sleeve is automatically moved towards a closed position.

In other alternate embodiments, the flow control valve has a valve member located in the central flow path of the inner body and moveable between an open position where fluids can pass through the central flow path, a closed position where fluids are prevented from passing through the central flow path, and intermediate positions between the open position and the closed position.

In another embodiment of this disclosure, a method for producing fluids from a wellbore having a main bore with an axis and a lower lateral bore includes setting a hollow whipstock in the main bore above the lower lateral bore and drilling an upper lateral bore, the hollow whipstock having a central bore. An upper completion is run into the main bore and set in the main bore axially above the upper lateral bore. The upper completion includes a sleeve assembly with a moveable inner sleeve having an outer diameter smaller than an inner diameter of the central bore of the hollow whipstock, and a moveable outer sleeve with an outer diameter larger than the inner diameter of the central bore of the hollow whipstock. A flow control valve has an inner tubing member in fluid communication with the sleeve assembly and an annular conduit in fluid communication with the main bore. An end of the moveable inner sleeve is inserted into the central bore of the hollow whipstock. The volume of fluids being produced from the lower lateral bore and from the upper lateral bore is controlled with the flow control valve.

In alternate embodiments, the end of the moveable inner sleeve is pulled out of the central bore of the hollow whipstock. An end of the moveable outer sleeve is inserted into the upper lateral bore. The upper lateral bore is accessed and a production procedure is performed in the upper lateral bore. The production procedure can be, for example, production logging, reservoir stimulation or water shut-off.

In other alternate embodiments, the step of pulling the end of the moveable inner sleeve out of the central bore of the hollow whipstock includes engaging the inner sleeve with an inner sleeve setting tool on wireline. The step of inserting the end of the moveable outer sleeve into the upper lateral bore can include engaging the outer sleeve with an outer sleeve setting tool on a coiled tubing.

In yet other alternate embodiments, the step of controlling the volume of fluids being produced from the lower lateral bore includes operating a valve member located in the lateral bore to move the valve member between an open position where fluids can pass through the inner tubing member of the flow control valve, to a closed position where fluids are prevented from passing through the inner tubing member of the flow control valve, and intermediate positions between the open position and the closed position. Alternately, the step of controlling the volume of fluids being produced from the upper lateral bore includes operating a choke member that is extendable across an exit port between the annular conduit and the inner tubing member, varying the cross sectional area of the port.

In still other alternate embodiments, the upper completion has a production packer and the step of setting the upper completion in the main bore includes setting the production packer in the main bore axially above the upper lateral bore.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments or positions.

In the following discussion, numerous specific details are set forth to provide a thorough understanding of the present invention. However, it will be obvious to those skilled in the art that the present invention can be practiced without such specific details. Additionally, for the most part, details concerning well drilling, reservoir testing, well completion and the like have been omitted inasmuch as such details, are not considered necessary to obtain a complete understanding of the present invention, and are considered to be within the skills of persons skilled in the relevant art.

Figure 1:
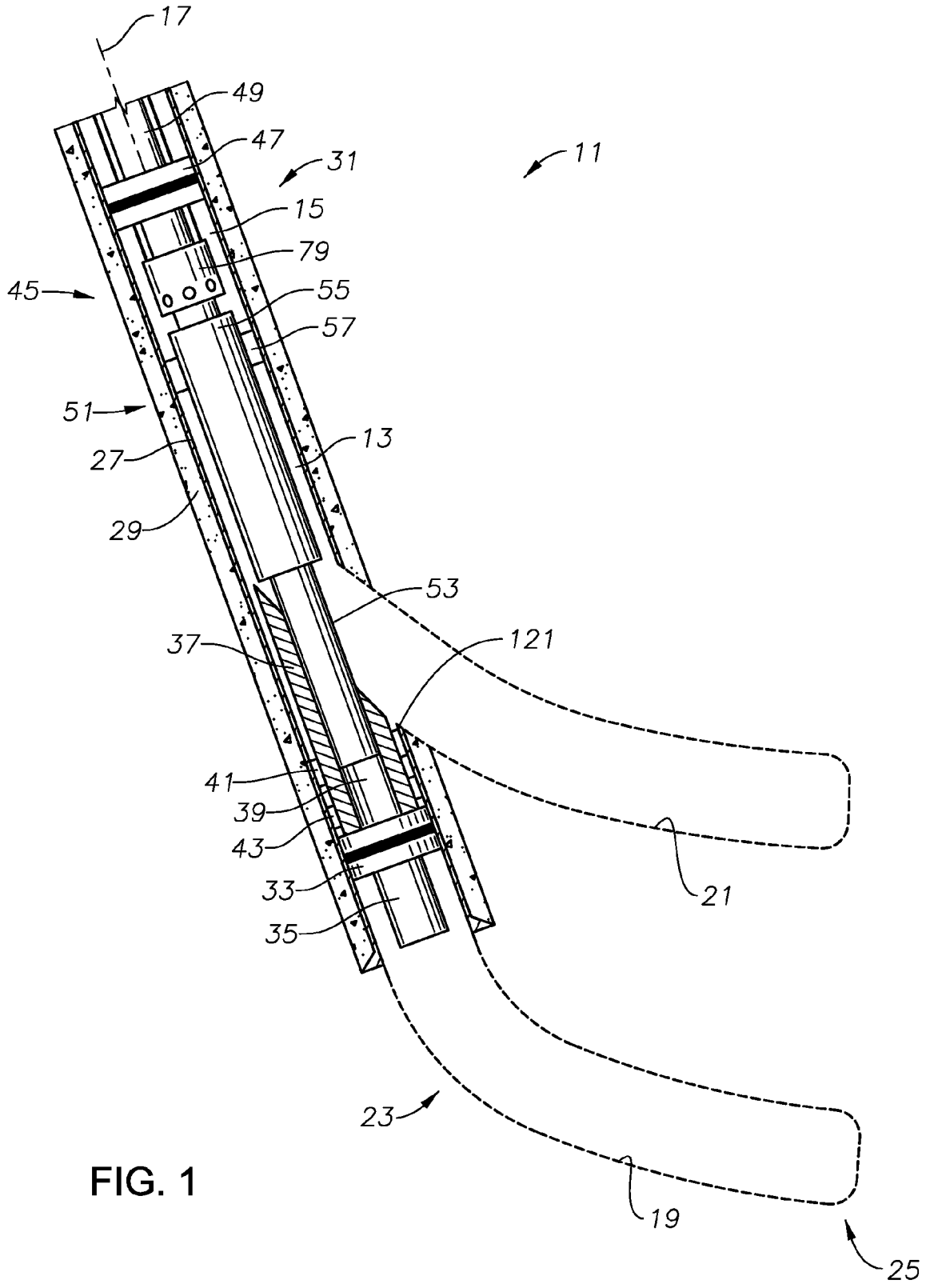
FIG. 1 is a schematic partial section view of a multi-lateral production system in accordance with an embodiment of this disclosure, shown with an end of the moveable inner sleeve located in the hollow whipstock.
Figure 2:
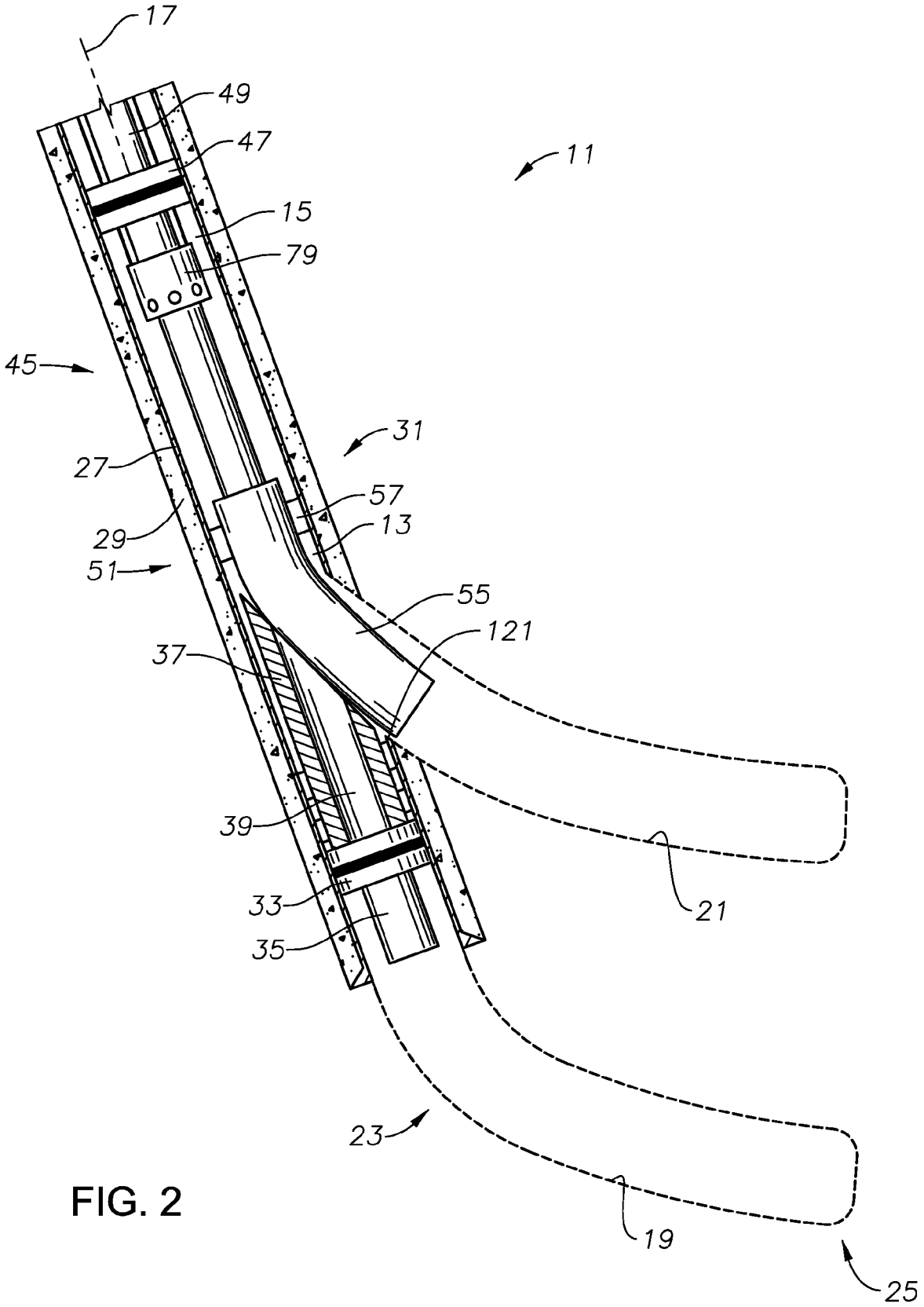
FIG. 2 is a schematic partial section view of the multi-lateral production system of FIG. 1, shown with and end of the moveable outer sleeve located in the upper lateral.

Referring to FIGS. 1-2, a multi-lateral well system 11 includes a wellbore 13. In the illustrated embodiment, wellbore 13 includes a main bore 15 with a central axis 17. Main bore 15 can be a vertical well bore or can be angled relative to a horizontal plane, as shown in FIGS. 1-2. Wellbore 13 also includes lower lateral bore 19 and upper lateral bore 21, each having a heel 23 and a toe 25 extending generally horizontally from main bore 15. Wellbore 13 can be installed with liner 27 which is cemented in place with a cement layer 29. Cement layer 29 can protect liner 27 and act as an isolation barrier. Upper and lower lateral bores 19, 21 can be uncased, as shown.

Production system 31 is located within wellbore 13. Production system 31 includes isolation packer 33 with tail pipe 35. Isolation packer 33 is set within main bore 15 axially located between lower lateral bore 19 and upper lateral bore 21. Tail pipe 35 is a tubular member that extends axially downward from isolation packer 33. A packer bore 36 (FIG. 3) extends through both the isolation packer 33 and tail pipe 35. Isolation packer 33 seals an annulus between tail pipe 35 and main bore 15 and can isolate main bore 15 axially above isolation packer 33 from fluids in wellbore 13 axially below isolation packer 33, other than fluids that pass through tail pipe 35.

Hollow whipstock 37 is set on top of isolation packer 33 so that a bottom surface of hollow whipstock 37 mates with a top surface of isolation packer 33. Hollow whipstock 37 has central bore 39 that extends through the axial length of hollow whipstock 37. Central bore 39 is in fluid communication with packer bore 36. Hollow whipstock 37 is secured within main bore 15 by anchor slips 41, which are located axially between lower lateral bore 19 and upper lateral bore 21. Packer element 43 can optionally be used to seal between an outer diameter of hollow whipstock 37 and an inner diameter of main bore 15.

Upper completion 45 is set in main bore 15 axially above upper lateral bore 21. Upper completion 45 is set within main bore 15 with production packer 47. Production packer 47 seals an annulus between tubular 49 and main bore 15, and can isolate main bore 15 axially above production packer 47 from fluids in wellbore 13 axially below production packer 47, other than fluids that pass through tubular 49. Tubular 49 can be, for example, production tubing.

Looking now at FIGS. 1-4 upper completion 45 includes sleeve assembly 51. An upper end of sleeve assembly 51 is located in main bore 15 axially above upper lateral bore 21. Sleeve assembly 51 has moveable inner sleeve 53 and moveable outer sleeve 55. Moveable inner sleeve 53 is a tubular shaped member with a central bore. Moveable inner sleeve 53 is sized to be selectively insertable into central bore 39 of hollow whipstock 37. For example, moveable inner sleeve 53 has an outer diameter that is smaller than an inner diameter of central bore 39 of hollow whipstock 37 and has a sufficient axial length to extend downward and into central bore 39 of hollow whipstock 37.

When the end of moveable inner sleeve 53 is located within the central bore 39 of hollow whipstock 37, at least one pressure seal 56 seals the annular space between the outer diameter of moveable inner sleeve 53 and the inner diameter of central bore 39. Therefore fluids in the wellbore 13 axially below isolation packer 33 can travel into tail pipe 35, through isolation packer 33 and into moveable inner sleeve 53.

Moveable outer sleeve 55 is a tubular shaped member with a central bore. The central bore of moveable outer sleeve 55 has a larger inner diameter than the outer diameter of moveable inner sleeve 53. Moveable outer sleeve 55 is concentric with, and circumscribes a portion of, moveable inner sleeve 53. An outer diameter of moveable outer sleeve 55 is larger than the inner diameter of central bore 39 of hollow whipstock 37 so that moveable outer sleeve 55 cannot be inserted into central bore 39 of hollow whipstock 37. Moveable outer sleeve 55 is instead sized to be selectively insertable into upper lateral bore 21. Stabilizers 57 are located on an outside surface of moveable outer sleeve 55 and be fixed on moveable outer sleeve 55 to move with moveable outer sleeve 55 within wellbore 13. Stabilizers 57 can be spaced around a circumference of moveable outer sleeve 55 and can center moveable outer sleeve 55 within wellbore 13.

Sleeve assembly 51 also includes intermediate member 59. Intermediate member 59 is a non-moveable tubular member with a central bore. Intermediate member 59 circumscribes a portion of moveable inner sleeve 53 and is circumscribed by a portion of moveable outer sleeve 55. Intermediate member 59 is statically secured within main bore 15 by production packer 47. Intermediate member 59 is coupled to production packer 47 by way of intermediate components of upper completion 45.

A series of locks 61 and grooves 63 of sleeve assembly 51 operate to maintain the desired position of moveable inner sleeve 53 and moveable outer sleeve 55 relative to intermediate member 59. Locks 61 can be spring loaded compressible locks and located proximate to an upper end of moveable inner sleeve 53 on an outer diameter of moveable inner sleeve. Similar locks can also be located proximate to an upper end of moveable outer sleeve 55, on an inner diameter surface of moveable outer sleeve 55. Locks 61 have an outer profile that mate with an inner profile of grooves 63. Grooves 63 for mating with locks 61 of moveable inner sleeve 53 are located at upper and lower ends of an inner diameter surface of intermediate member 59. Grooves 63 for mating with locks 61 of moveable outer sleeve 55 are located at upper and lower ends of an outer diameter surface of intermediate member 59.

Intermediate member 59 also includes an inner stop ring 65 and an outer stop ring 67. Inner stop ring 65 can engage a stop ring, lock 61 or other protrusion of moveable inner sleeve 53 to limit downward axial moveable inner sleeve 53 and prevent moveable inner sleeve 53 from traveling completely out of the lower end of intermediate member 59. Outer stop ring 67 can engage a stop ring, lock 61 or other protrusion of moveable outer sleeve 55 to limit downward axial moveable outer sleeve 55 and prevent moveable inner sleeve 53 from traveling completely out of the lower end of intermediate member 59.

Figure 3:
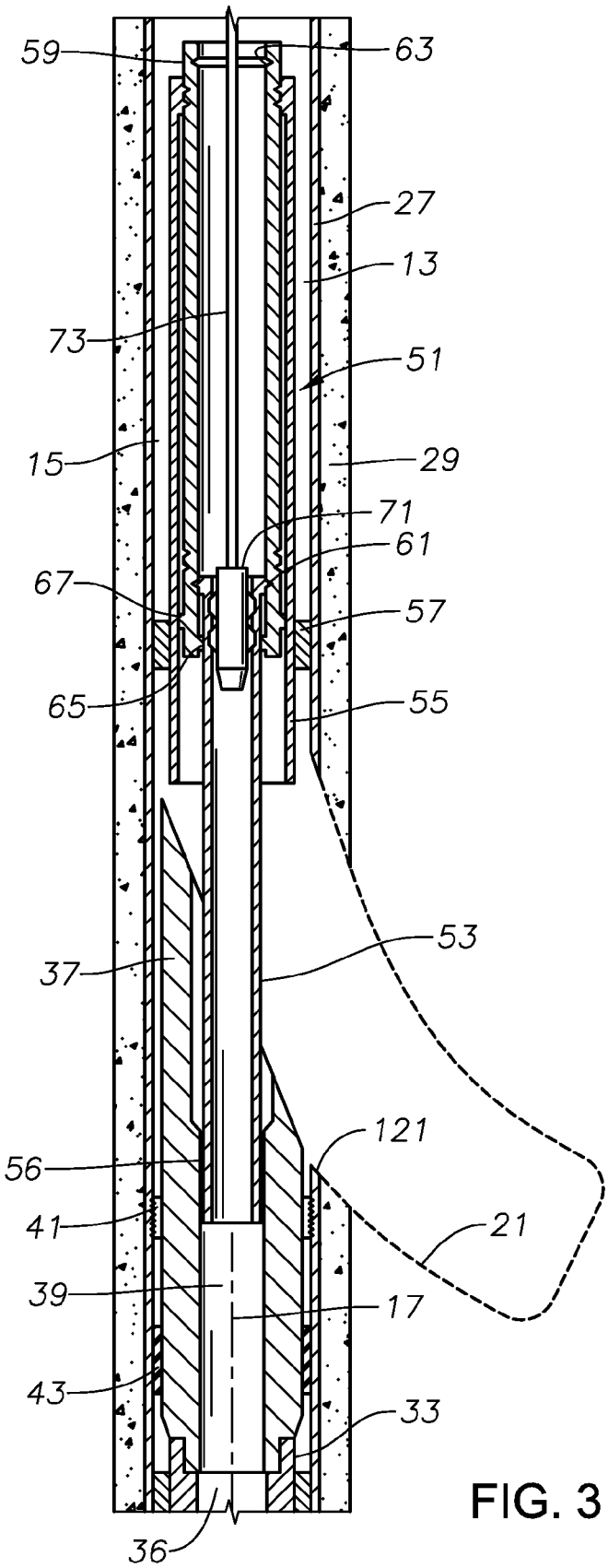
FIG. 3 is a schematic section view of the sleeve assembly of FIG. 1, shown with an end of the moveable inner sleeve located in the hollow whipstock.
Figure 4:
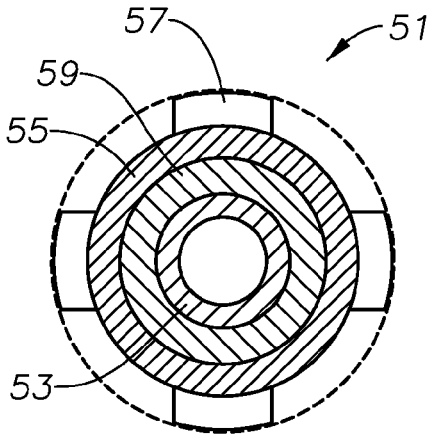
FIG. 4 is a schematic cross section view of the sleeve assembly of FIG. 3.
Figure 5:
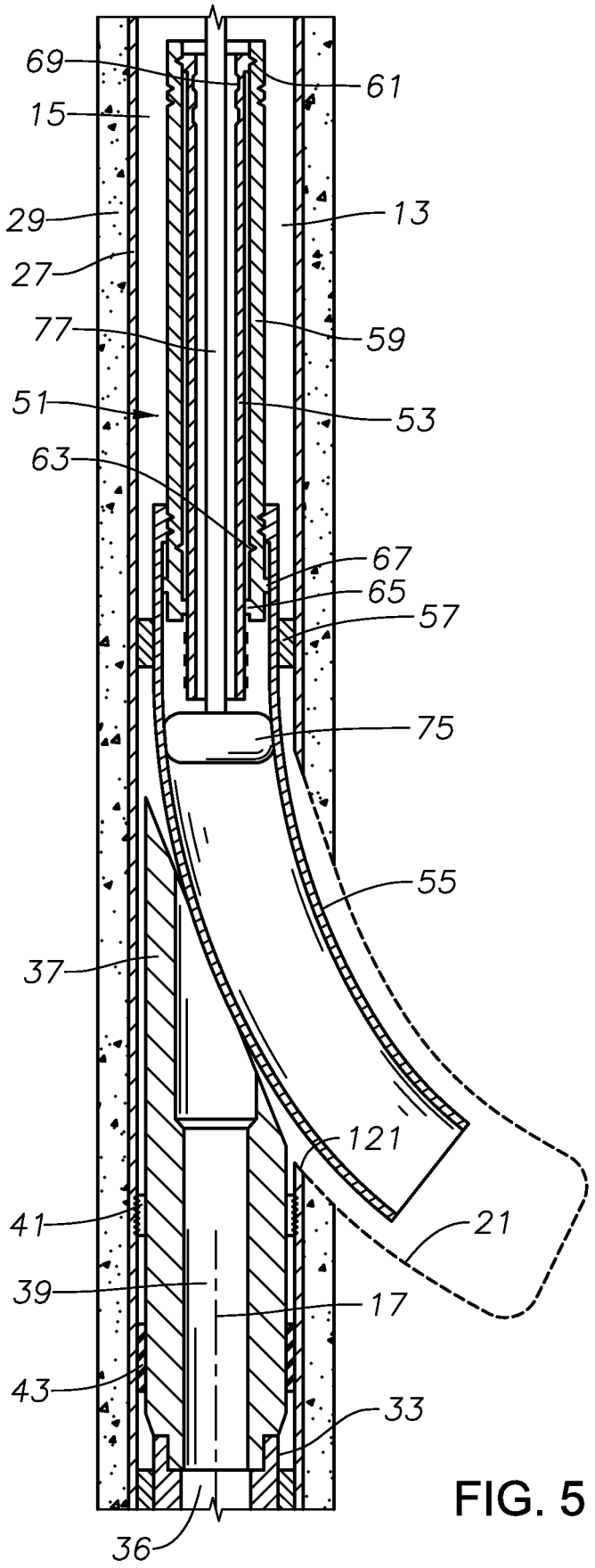
FIG. 5 is a schematic section view of the sleeve assembly of FIG. 1, shown with the moveable outer sleeve in an extended position.

Each of the moveable inner sleeve 53 and moveable outer sleeve 55 have extended and contracted positions, relative to intermediate member 59. As seen in FIG. 3, when moveable inner sleeve 53 is in an extended position, a maximal length of moveable inner sleeve 53 protrudes from a bottom end of intermediate member 59 and the end of moveable inner sleeve 53 is located within central bore 39 of hollow whipstock 37. In such an extended position, lock 61 of movable inner sleeve 53 is located within groove 63 located at the lower end of intermediate member 59. As seen in FIG. 5, when moveable inner sleeve 53 is in a contracted position, a lesser length of moveable inner sleeve 53 protrudes from a bottom end of intermediate sleeve 59. In such a contracted position, lock 61 of moveable inner sleeve 53 is located within groove 63 located at the upper end of intermediate member 59.

Looking now at FIGS. 3 and 5, moveable inner sleeve 53 has a sleeve profile 69 on an inner diameter of inner sleeve 53, proximate to the upper end of moveable inner sleeve 53. In order to move moveable inner sleeve 53 between the extended position and contracted position, inner sleeve setting tool 71 can be lowered through wellbore 13 and into the central bore of moveable inner sleeve 53 on a wireline 73. An outer profile on inner sleeve setting tool 71 can engage sleeve profile 69 and wireline 73 can be used to raise and lower moveable inner sleeve 53.

As seen in FIG. 5, when moveable outer sleeve 55 is in an extended position, a maximal length of moveable outer sleeve 55 protrudes from a bottom end of intermediate member 59 and the end of moveable outer sleeve 55 is located within upper lateral bore 21. In the extended position, moveable outer sleeve 55 is in a bent or curved shape in order to extend through the transition between main bore 15 and upper lateral bore 21. In such an extended position, lock 61 of moveable outer sleeve 55 is located within groove 63 located at a lower end of intermediate member 59. As seen in FIG. 3, when moveable outer sleeve 55 is in a contracted position, a lesser length of moveable outer sleeve 55 protrudes from a bottom end of intermediate member 59. In such a contracted position, lock 61 of moveable outer sleeve 55 is located within groove 63 located at the upper end of intermediate sleeve 59.

Looking now at FIG. 5, in order to move moveable outer sleeve 55 between the extended position and contracted position, outer sleeve setting tool 75 can be lowered through wellbore 13, through the central bore of moveable inner sleeve 53, and into the central bore of movable outer sleeve 55, on coiled tubing 77. Outer sleeve setting tool 75 can be an inflatable packer that is then inflated to engage the central bore of moveable outer sleeve 55. Coiled tubing 77 can be used to raise and lower moveable outer sleeve 55.

Turning now to FIGS. 1-2 and 6-8, upper completion 45 also includes flow control valve 79. Flow control valve 79 is located in main bore 15 axially above upper lateral bore 21. Flow control valve 79 has inner tubing member 81, which is an inner body with a central flow path 83. Central flow path 83 of inner tubing member 81 is in fluid communication with sleeve assembly 51. Flow control valve 79 also has outer casing 85, which is tubular member that circumscribes a portion of inner tubing member 81. Annular conduit 87 is defined between outer casing 85 and inner tubing member 81. Annular conduit 87 is in fluid communication with main bore 15 between isolation packer 33 and production packer 47.

Inner tubing member 81 has tubing entry end 89 in fluid communication with sleeve assembly 51, and tubing exit end 91 that is in fluid communication with main bore 15 above production packer 47. Annular conduit 87 has annular entry end 93 in fluid communication with main bore 15 axially below production packer 47, and exit port 95 in fluid communication with tubing exit end 91. Exit port 95 can be a radially extending bore through a sidewall of tubing member 81. A plurality of exit ports 95 can be spaces round inner tubing member 81.

Flow control valve 79 includes sliding sleeve system 97. Sliding sleeve system 97 includes sliding sleeve 99 that is moveable between an open position where fluids from annular conduit 87 can flow into exit port 95, and a closed position where fluids from annular conduit 87 are prevented from flowing into exit port 95. Sliding sleeve 99 is a generally tubular member that circumscribes inner tubing member 81. An end of sliding sleeve 99 has opening pressure surface 101 on one side and closing pressure surface 103 on an opposite side. Opening pressure surface 101 is acted on by fluid from main bore 15 between isolation packer 33 and production packer 47 that flows into annular conduit 87 of flow control valve 79. The force of such fluids acting on opening pressure surface 101 urges sliding sleeve 99 towards the open position.

Figure 6:
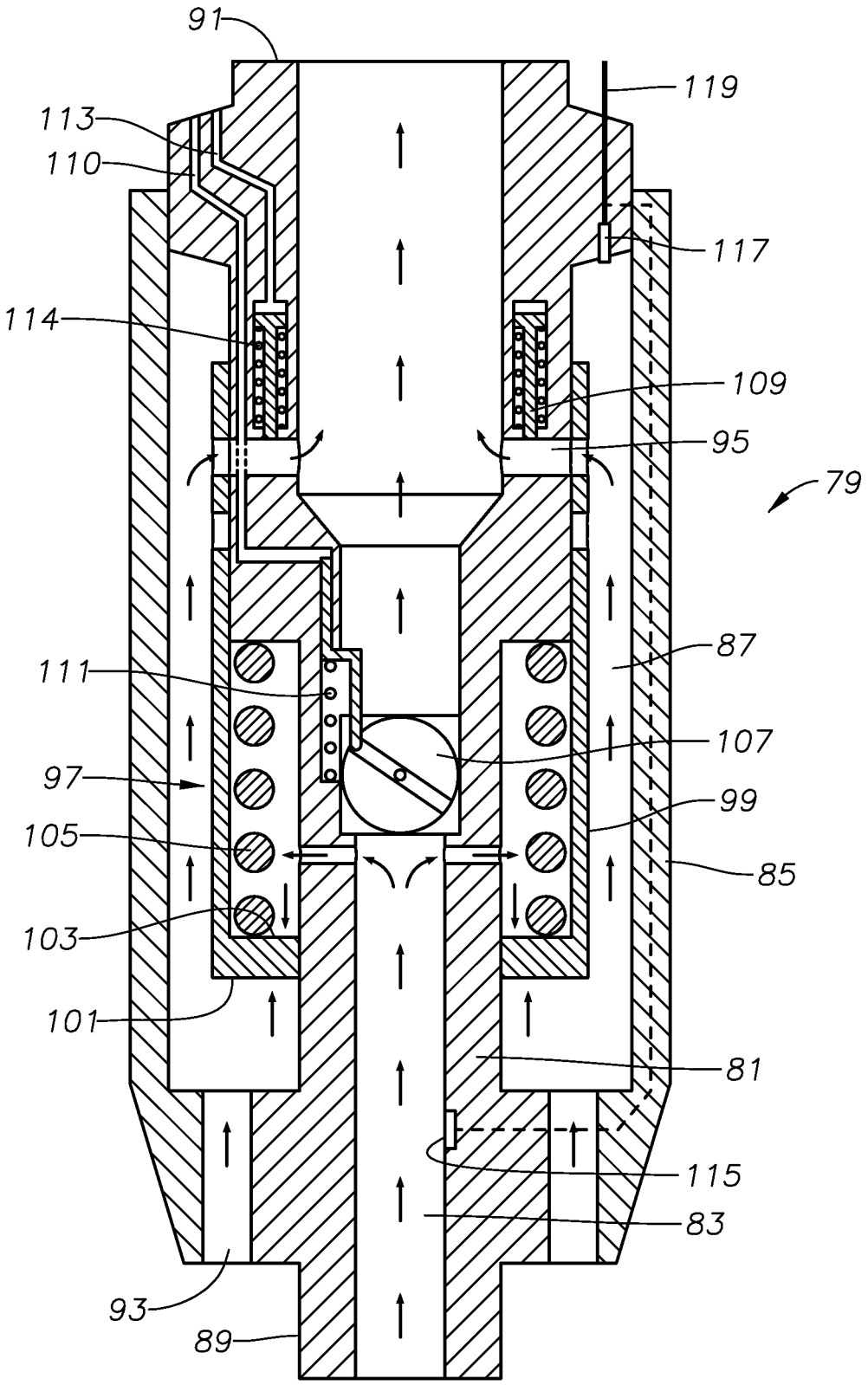
FIG. 6 is a schematic section view of the flow control valve of FIG. 1, shown with the sliding sleeve in an open position, the valve member in an open position, and the choke member in a retracted position.
Figure 7:
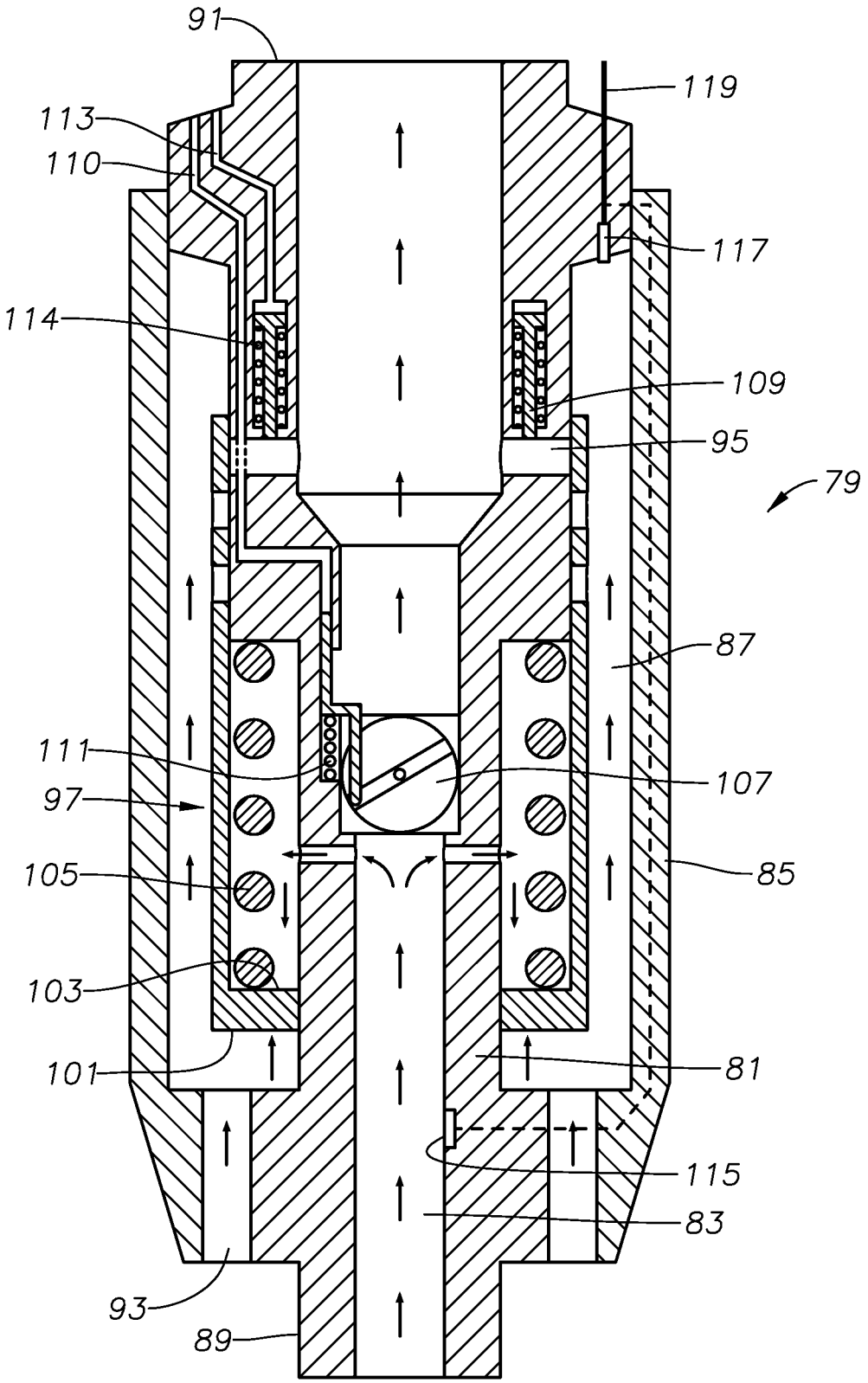
FIG. 7 is a schematic section view of the flow control valve of FIG. 1, shown with the sliding sleeve in a closed position, the valve member in a closed position, and the choke member in a retracted position.
Figure 8:
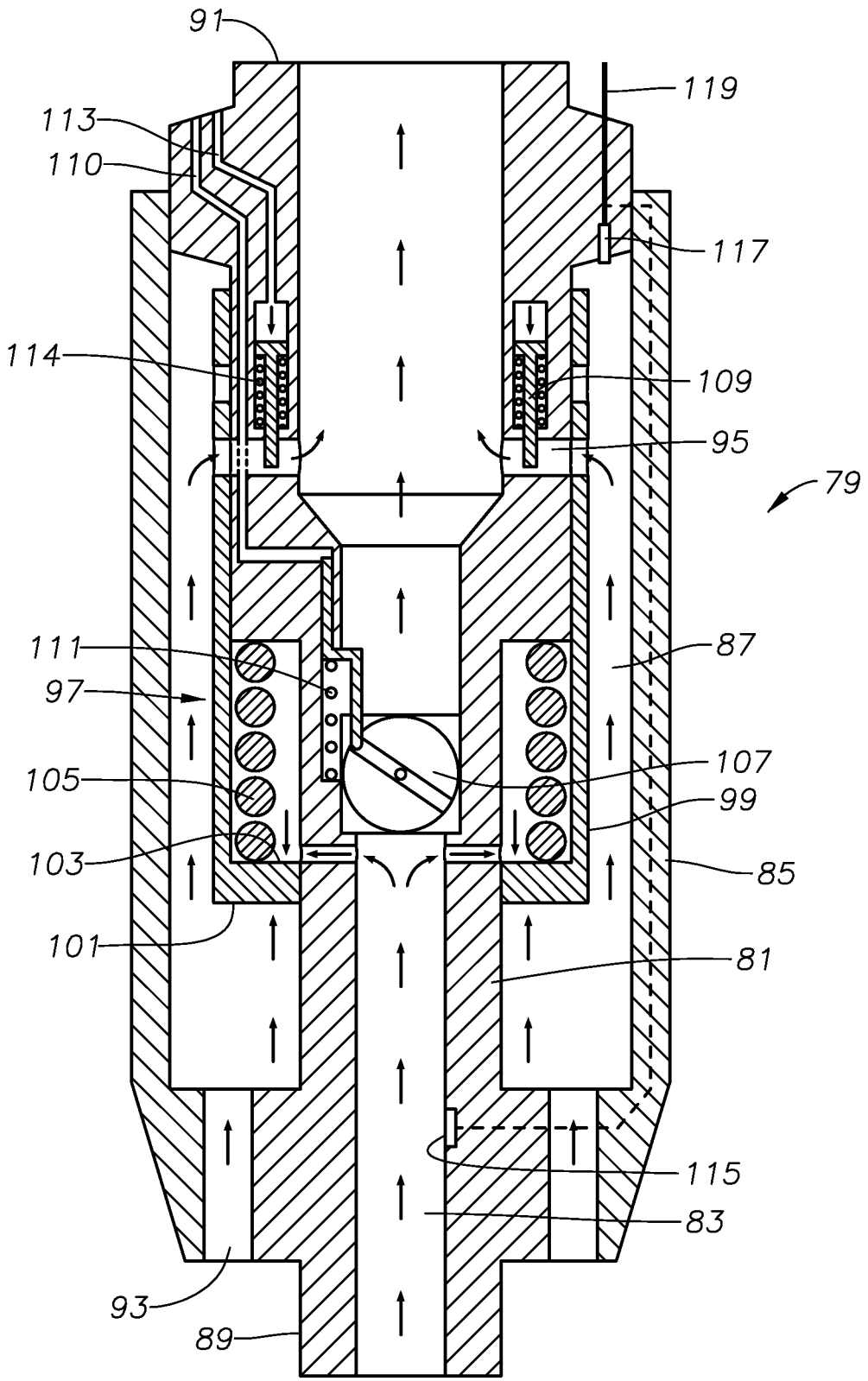
FIG. 8 is a schematic section view of the flow control valve of FIG. 1, shown with the sliding sleeve in an open position, the valve member in an open position, and the choke member in an extended position.

Closing pressure surface 103 is acted on by biasing member 105, urging sliding sleeve 99 towards the open position when biasing member 105 is compressed (FIG. 8), and urging sliding sleeve 99 towards the closed position when biasing member 105 is extended (FIG. 7). In addition, closing pressure surface 103 is acted on by fluid from inner tubing member 81. When the forces of fluids from inner tubing member 81 and biasing member 105 acting on closing pressure surface 103 exceeds the forces on opening pressure surface 101 by fluids in annular conduit 87, sliding sleeve 99 is moved towards the closed position, as shown in FIG. 7. Conversely, when the forces on opening pressure surface 101 by fluids in annular conduit 87 exceed the forces of fluids from inner tubing member 81 and biasing member 105 acting on closing pressure surface 103, sliding sleeve 99 is moved towards the open position, as shown in FIGS. 6 and 8. When the forces on opening pressure surface 101 by fluids in annular conduit 87 is essentially equal to the forces of fluids from inner tubing member 81 acting on closing pressure surface 103, biasing member 105 will be relaxed and sliding sleeve 99 is in a neutral position, as shown in FIG. 6. In the neutral position, fluids from annular conduit 87 can flow into exit port 95. Biasing member 105 can be, for example, a spring.

Looking at FIGS. 6-8, flow control valve 79 additionally includes valve member 107 that is located within inner tubing member 81. Valve member 107 is moveable between an open position where fluids can pass through inner tubing member 81 of flow control valve 79, as seen in FIGS. 6 and 8. Valve member 107 is also movable to a closed position where fluids are prevented from passing through inner tubing member 81 of flow control valve 79 (not shown). Valve member 107 can be located at intermediate positions between the open position and the closed position where some fluids can pass through inner tubing member 81 of flow control valve 79, as seen in FIG. 7. Valve member 107 can be a hydraulically operated ball valve. A hydraulic control system can include hydraulic control line 110 for moving valve member 107 to a closed position. A spring member 111 can urge valve member 107 towards a normal open position.

Looking again at FIGS. 6-8, flow control valve 79 has a choke member 109. Choke member 109 can be a pin that extends across exit port 95, varying the cross sectional area of exit port 95 so that the flow from of fluids annular conduit 87 to central flow path 83 through exit port 95 is restricted. The hydraulic control system can also include hydraulic control line 113 for moving choke member 109 into an extended condition into exit port 95. Spring 114 can urge choke member 109 into a retracted position where choke member does not extend into exit port 95. Each exit port 95 can have a separate choke member 109.

Flow control valve 79 can further include tubing pressure gauge 115 and annular conduit pressure gauge 117. Tubing pressure gauge 115 is located in, or adjacent to, central flow path 83 and can sense an inner tubing fluid pressure, that is, the pressure of the fluid within central flow path 83 of inner tubing member 81. Annular conduit fluid pressure gauge 117 is located in, or adjacent to, annular conduit 87 cam can sense an annular conduit fluid pressure, that is, the pressure of the fluids within annular conduit 87. Data cable 119 can transmit pressure data from tubing pressure gauge 115 and annular conduit pressure gauge 117 to an operator.

In an example of operation, looking at FIG. 1, main bore 15 can be drilled and liner 27 can be cemented in place in a conventional manner. Liner 27 can be cleaned out and lower lateral bore 19 can be drilled. Lower lateral bore 19 can be cleaned out and displacement operations can be undertaken with brine in lower lateral bore 19. Isolation packer 33 with tail pipe 35 can be set within main bore 15. Tail pipe 35 can have a ceramic disk or retrievable plug (not shown) to prevent fluids from passing through tail pipe 35 while production system 31 is installed in wellbore 13.

Hollow whipstock 37 can then be run into wellbore 13, oriented, and set on top of isolation packer 33 in main bore 15. Hollow whipstock 37 can have a debris catcher (not shown) located within central bore 39. Exit window 121 can be cut through liner 27 and cement layer 29 and upper lateral bore 21 can be drilled with a directional drilling assembly. Upper lateral bore 21 can be cleaned out and displacement operations can be undertaken with brine in upper lateral bore 21. The debris catcher can then be retrieved from the central bore 39 of hollow whipstock 37.

Upper completion 45 can be run into main bore 15 and set. Production packer 47 can set upper completion 45 in main bore 15 axially above upper lateral bore 21. Moveable inner sleeve 53 can be in an extended position and the end of moveable inner sleeve 53 can be inserted into central bore 39 of hollow whipstock 37. Ceramic disk located in tail pipe 35 can then be ruptured, or retrievable plug located in tail pipe 35 can be retrieved, as applicable. Well system 11 is now ready to begin producing.

Because the end of moveable inner sleeve 53 is sealingly located in central bore 39 of hollow whipstock 37, fluids entering central flow path 83 of flow control valve 79 will be from lower lateral bore 19 and fluids entering annular conduit 87 will be from upper lateral bore 21. Flow control valve 79 can both automatically and mechanically control the volume of fluids being produced from lower lateral bore 19 and upper lateral bore 21. Looking at FIG. 6, when the pressure of fluids in annular conduit 87 is similar to the pressure of fluids in central flow path 83, sliding sleeve 99 is in the neutral position, and biasing member 105 is relaxed. Fluids from annular conduit 87 can flow into exit port 95. With valve member 107 in the open position and choke member 109 in the retracted position, both lower lateral bore 19 and upper lateral bore 21 are being produced.

Turning to FIG. 7, when the pressure of fluids in annular conduit 87 is significantly less than the pressure of fluids in central flow path 83, biasing member 105 is in an extended position and sliding sleeve 99 is in the closed position. Fluids from annular conduit 87 cannot flow into exit port 95 and only fluids from lower lateral bore 19 can be produced. This will prevent dumping into the upper lateral bore 21. As pressure depletes in the lower lateral bore 19 and becomes similar to the pressure of upper lateral bore 21, siding sleeve 99 will automatically move to the neutral position and both lower lateral bore 19 and upper lateral bore 21 will be produced, as shown in FIG. 6.

Turning now to FIG. 8, when the pressure of fluids in annular conduit 87 is significantly greater than the pressure of fluids in central flow path 83, biasing member 105 is in a contracted position and sliding sleeve 99 is in the open position. Fluids from annular conduit 87 can flow into exit port 95. Although fluids from both lower lateral bore 19 and upper lateral bore 21 can be produced, due to the difference in pressures, it will be mainly fluids from upper lateral bore 21 that are being produced. In this way, flow control valve will automatically allow the higher pressure reservoir produce first.

The operator can at any time review pressure data received from tubing pressure gauge 115 and annular conduit pressure gauge 117 by way of data cable 119. The operator can choose to use the hydraulic control system to move valve member 107 into an intermediate or closed position (FIG. 7) in order to reduce or stop the flow of produced fluids from lower lateral bore 19, to optimize production. The operator can also choose to use the hydraulic control system to extend choke member 109 partially into, or fully across exit port 95 (FIG. 8) in order to reduce or stop the flow of produced fluids from upper lateral bore 21, to optimize production.

Turning back to FIG. 3, if is desirable for a production procedure, such as production logging, reservoir stimulation or water shut-off, to be performed in upper lateral bore 21, inner sleeve setting tool 71 can be lowered into wellbore 13 on wireline 73. The outer profile on inner sleeve setting tool 71 can engage sleeve profile 69 and wireline 73 can be used to pull moveable inner sleeve 53 upwards and into the intermediate sleeve 59 so that movable inner sleeve 53 is in the contracted position and lock 61 of moveable inner sleeve 53 is located within groove 63 located at the upper end of intermediate sleeve 59. Inner sleeve setting tool 71 can then be retrieved.

Looking now at FIG. 5, outer sleeve setting tool 75 can then be run into wellbore 13 on coiled tubing 77. After passing completely through moveable inner sleeve 53, outer sleeve setting tool 75 can be inflated to engage moveable outer sleeve 55. Moveable outer sleeve 55 can then be moved downward. Because the outer diameter of moveable outer sleeve 55 is too large to fit within central bore 39 of hollow whipstock 37, hollow whipstock 37 will defect the lower end of moveable outer sleeve 55 into upper lateral bore 21. Moveable outer sleeve 55 can be moved downward until lock 61 of moveable outer sleeve 55 is located within groove 63 located at a lower end of intermediate member 59. Outer sleeve setting tool 75 can then be deflated and retrieved. Upper lateral bore 21 is then ready for reservoir access procedures such as, for example, logging, stimulation, or water-shut-off. Moveable outer sleeve 55 is not sealingly engaged with upper lateral bore 21. Therefore, while the lower end of moveable outer sleeve 55 is located in upper lateral bore 21, fluids from both lower lateral bore 19 and upper lateral bore 21 will mingle and can enter either central flow path 83 or annular conduit 87. If the lower lateral bore 19 is required for pressure isolation during the above stated procedure in the upper lateral bore, a retrievable plug can be run and set in the tail pipe 35 (not shown).

The use of hollow whipstock 37 eliminates the common practice of retrieving the whipstock, and ensures an effective production conduit and full access to lower lateral bore 19. Sleeve assembly 51 enables full access to both lower lateral bore 19 and upper lateral bore 21 for reservoir production logging, stimulation, and or water shut-off process. Sleeve assembly 51 also enables a bigger pass-through diameter for full access to both laterals, than traditional methods. Flow control valve 79 provides automated flow control and downhole pressure gauge data collection for production monitoring purpose and independent choke mechanisms for both lower lateral bore 19 and upper lateral bore 21 by way of the hydraulic control system.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A production system for use in a wellbore having a main bore with an axis, a lower lateral bore, and an upper lateral bore, the system comprising:

a hollow whipstock with a central bore, the hollow whipstock being secured to the main bore between the lower lateral bore and the upper lateral bore;

a sleeve assembly, the sleeve assembly having:

a moveable inner sleeve with an outer diameter smaller than an inner diameter of the central bore of the hollow whipstock, the moveable inner sleeve selectively moveable between an extended position where an end of the inner sleeve is located within the central bore of the hollow whipstock and a contracted position where the end of the moveable inner sleeve is spaced apart from the hollow whipstock; and a moveable outer sleeve with an outer diameter larger than the inner diameter of the central bore of the hollow whipstock, the moveable outer sleeve selectively moveable between an extended position where an end of the outer sleeve is located within the upper lateral bore and a contracted position where the end of the moveable outer sleeve is spaced apart from the upper lateral bore; and a flow control valve located in the main bore above the upper lateral bore, the flow control valve having an inner tubing member in selective fluid communication with the lower lateral bore and an annular conduit in selective fluid communication with the upper lateral bore.

2. The system according to claim 1, wherein:

the sleeve assembly has an upper end located in the main bore axially above the upper lateral bore; and the inner sleeve is sized to be selectively insertable into the central bore of the hollow whipstock; and the outer sleeve is sized to be selectively insertable into the upper lateral bore.

3. The system according to claim 1, wherein the sleeve assembly has an intermediate member that circumscribes a portion of the moveable inner sleeve and is circumscribed by a portion of the moveable outer sleeve, the intermediate member being a tubular member statically secured within the main bore.

4. The system according to claim 1, wherein the flow control valve has a sliding sleeve system, the sliding sleeve system comprising:

a sliding sleeve moveable between an open position where fluids from the annular conduit can flow into an exit port of the annular conduit, and a closed position where fluids from the annular conduit are prevented from flowing into the exit port;

a biasing member urging the sliding sleeve towards the open position or towards the closed position;

an opening pressure surface, the opening pressure surface acted on by main bore fluids; and a closing pressure surface, the closing pressure surface acted on by inner tubing member fluids such that when forces on the closing pressure surface exceed forces on the opening pressure surface and overcome the biasing member, the sliding sleeve is moved towards the closed position.

5. The system according to claim 1, wherein:

the system has a production packer sealing the main bore axially above the sleeve assembly;

the inner tubing member of the flow control valve has a tubing entry end in fluid communication with the sleeve assembly, and a tubing exit end in fluid communication with the main bore axially above the production packer; and the annular conduit of the flow control valve has an annulus entry end in fluid communication with the main bore axially below the production packer, and an exit port in fluid communication with the tubing exit end.

6. The system according to claim 1, wherein the flow control valve has a valve member located in the inner tubing member moveable between an open position where fluids can pass through the inner tubing member of the flow control valve, a closed position where fluids are prevented from passing through the inner tubing member of the flow control valve, and intermediate positions between the open position and the closed position.

7. The system according to claim 1, wherein the flow control valve has a choke member, the choke member being extendable across an annular exit port, varying a cross sectional area of the annular exit port.

8. The system according to claim 1, further comprising an inner tubing member pressure gauge sensing an inner tubing member fluid pressure, and pressure an annular conduit pressure gauge sensing an annular conduit fluid pressure.

9. The system according to claim 1, further comprising a hydraulic control system in communication with a valve member located in the inner tubing member and with a choke member located between a central flow path of the inner tubing member and the annular conduit.

10. A production system for use in a wellbore having a main bore with an axis, a lower lateral bore, and an upper lateral bore, the system comprising:

a hollow whipstock with a central bore, the hollow whipstock being secured to the main bore between the lower lateral bore and the upper lateral bore;

a sleeve assembly, the sleeve assembly having:

a moveable inner sleeve with an outer diameter smaller than an inner diameter of the central bore of the hollow whipstock;

a moveable outer sleeve with an outer diameter larger than the inner diameter of the central bore of the hollow whipstock; and an intermediate sleeve located between the moveable inner sleeve and the moveable outer sleeve, the intermediate sleeve being statically secured within the main bore, wherein the moveable inner sleeve is selectively moveable between an extended position and a contracted position relative to the intermediate sleeve and the moveable outer sleeve selectively moveable between an extended position and a contracted position relative to the intermediate sleeve; and a flow control valve located in the main bore above the upper lateral bore, the flow control valve having an inner body with a central flow path in fluid communication with the sleeve assembly, and an outer casing circumscribing a portion of the inner body and defining an annular conduit between the inner body and the outer casing, the annular conduit being in fluid communication with the main bore.

11. The system according to claim 10, wherein the flow control valve has a sliding sleeve system, the sliding sleeve system comprising:

a sliding sleeve moveable between an open position where fluids from the annular conduit can flow from the annular conduit into an exit port of the annular conduit, and a closed position where fluids from the annular conduit are prevented from flowing into the exit port;

a biasing member urging the sliding sleeve towards the open position or the closed position;

an opening pressure surface, the opening pressure surface acted on by main bore fluids; and a closing pressure surface, the closing pressure surface acted on by central flow path fluids such that when forces on the closing pressure surface exceeds forces on the opening pressure surface and overcome the biasing member, the sliding sleeve is automatically moved towards a closed position.

12. The system according to claim 10, wherein the flow control valve has a valve member located in the central flow path of the inner body and moveable between an open position where fluids can pass through the central flow path, a closed position where fluids are prevented from passing through the central flow path, and intermediate positions between the open position and the closed position.

13. A method for producing fluids from a wellbore having a main bore with an axis and a lower lateral bore, the method comprising:

setting a hollow whipstock in the main bore above the lower lateral bore and drilling an upper lateral bore, the hollow whipstock having a central bore;

running an upper completion into the main bore and setting the upper completion in the main bore axially above the upper lateral bore, the upper completion having:

a sleeve assembly with a moveable inner sleeve having an outer diameter smaller than an inner diameter of the central bore of the hollow whipstock, the moveable inner sleeve selectively moveable between an extended position where an end of the inner sleeve is located within the central bore of the hollow whipstock and a contracted position where the end of the moveable inner sleeve is spaced apart from the hollow whipstock, and a moveable outer sleeve with an outer diameter larger than the inner diameter of the central bore of the hollow whipstock, the moveable outer sleeve selectively moveable between an extended position where an end of the outer sleeve is located within the upper lateral bore and a contracted position where the end of the moveable inner sleeve is spaced apart from the upper lateral bore; and a flow control valve having an inner tubing member in fluid communication with the sleeve assembly and an annular conduit in fluid communication with the main bore;

inserting an end of the moveable inner sleeve into the central bore of the hollow whipstock; and controlling a volume of fluids being produced from the lower lateral bore and from the upper lateral bore with the flow control valve.

14. The method according to claim 13, further comprising:

pulling the end of the moveable inner sleeve out of the central bore of the hollow whipstock;

inserting an end of the moveable outer sleeve into the upper lateral bore; and accessing the upper lateral bore and performing a production procedure in the upper lateral bore.

15. The method according to claim 14, wherein the production procedure is selected from a group consisting of production logging, reservoir stimulation and water shut-off.

16. The method according to claim 14, wherein the step of pulling the end of the moveable inner sleeve out of the central bore of the hollow whipstock includes engaging the inner sleeve with an inner sleeve setting tool on a wireline.

17. The method according to claim 14, wherein the step of inserting the end of the moveable outer sleeve into the upper lateral bore includes engaging the outer sleeve with an outer sleeve setting tool on a coiled tubing.

18. The method according to claim 13, wherein the step of controlling the volume of fluids being produced from the lower lateral bore includes operating a valve member located in the lateral bore to move the valve member between an open position where fluids can pass through the inner tubing member of the flow control valve, to a closed position where fluids are prevented from passing through the inner tubing member of the flow control valve, and intermediate positions between the open position and the closed position.

19. The method according to claim 13, wherein the step of controlling the volume of fluids being produced from the upper lateral bore includes operating a choke member that is extendable across an exit port between the annular conduit and the inner tubing member, varying a cross sectional area of the port.

20. The method according to claim 13, wherein the upper completion has a production packer and the step of setting the upper completion in the main bore includes setting the production packer in the main bore axially above the upper lateral bore.

21. A production system for use in a wellbore having a main bore with an axis, a lower lateral bore, and an upper lateral bore, the system comprising:

a hollow whipstock with a central bore, the hollow whipstock being secured to the main bore between the lower lateral bore and the upper lateral bore;

a sleeve assembly, the sleeve assembly having:

a moveable inner sleeve with an outer diameter smaller than an inner diameter of the central bore of the hollow whipstock; and a moveable outer sleeve with an outer diameter larger than the inner diameter of the central bore of the hollow whipstock; and a flow control valve located in the main bore above the upper lateral bore, the flow control valve having an inner tubing member in selective fluid communication with the lower lateral bore and an annular conduit in selective fluid communication with the upper lateral bore; wherein the flow control valve has a sliding sleeve system, the sliding sleeve system comprising:

a sliding sleeve moveable between an open position where fluids from the annular conduit can flow into an exit port of the annular conduit, and a closed position where fluids from the annular conduit are prevented from flowing into the exit port;

a biasing member urging the sliding sleeve towards the open position or towards the closed position;

an opening pressure surface, the opening pressure surface acted on by main bore fluids; and a closing pressure surface, the closing pressure surface acted on by inner tubing member fluids such that when forces on the closing pressure surface exceed forces on the opening pressure surface and overcome the biasing member, the sliding sleeve is moved towards the closed position.

22. A production system for use in a wellbore having a main bore with an axis, a lower lateral bore, and an upper lateral bore, the system comprising:

a hollow whipstock with a central bore, the hollow whipstock being secured to the main bore between the lower lateral bore and the upper lateral bore;

a sleeve assembly, the sleeve assembly having:

a moveable inner sleeve with an outer diameter smaller than an inner diameter of the central bore of the hollow whipstock; and a moveable outer sleeve with an outer diameter larger than the inner diameter of the central bore of the hollow whipstock; and a flow control valve located in the main bore above the upper lateral bore, the flow control valve having an inner tubing member in selective fluid communication with the lower lateral bore and an annular conduit in selective fluid communication with the upper lateral bore; wherein the system has a production packer sealing the main bore axially above the sleeve assembly;

the inner tubing member of the flow control valve has a tubing entry end in fluid communication with the sleeve assembly, and a tubing exit end in fluid communication with the main bore axially above the production packer; and the annular conduit of the flow control valve has an annulus entry end in fluid communication with the main bore axially below the production packer, and an exit port in fluid communication with the tubing exit end.

* * * * *